US006361475B1

(12) United States Patent
Jobe

(10) Patent No.: US 6,361,475 B1
(45) Date of Patent: Mar. 26, 2002

(54) JAW EXERCISING DEVICE

(75) Inventor: Richard P. Jobe, Los Altos, CA (US)

(73) Assignee: Meddev Corporation, Palo Alto, CA (US)

( * ) Notice: Subject to any disclaimer, the term of this patent is extended or adjusted under 35 U.S.C. 154(b) by 0 days.

(21) Appl. No.: 09/450,922

(22) Filed: Nov. 29, 1999

(51) Int. Cl.[7] ..... A63B 23/03

(52) U.S. Cl. ..... 482/11

(58) Field of Search ..... 482/10–11, 121–122, 482/124; D21/662, 692

(56) References Cited

U.S. PATENT DOCUMENTS 5,176,594 A * 1/1993 Lee ..... 482/11
5,746,703 A * 5/1998 Levatino ..... 601/38

* cited by examiner

*Primary Examiner*—Denise Pothier
(74) *Attorney, Agent, or Firm*—Flehr Hohbach Test Albritton & Herbert LLP

(57) ABSTRACT

A jaw exercising device which includes an outer frame having spaced apart cross members and an inner frame with spaced apart cross members coupled to the outer frame for movement therealong and outwardly extending blades for engaging the jaws of a patient carried by adjacent cross members of the outer and inner frame.

7 Claims, 4 Drawing Sheets

10
12
13
14
16
17
22
23
24
26
27
28
29
34

JAW EXERCISING DEVICE

BRIEF DESCRIPTION OF THE INVENTION

This invention relates to a jaw exercising device and more particularly to a jaw exercising device in which the jaw can be manually exercised

BACKGROUND OF THE INVENTION

Jaw exercising devices are used by patients recovering from injuries to the bones and muscles of the face and neck, from reconstructive surgery, arthritis, radiation therapy among other things to improve the facial muscles.

Jaw exercising devices have taken many forms, from bite pads such as shown in U.S. Pat. No. 5,582,560, to wedge-shaped plastic bodies which engage the teeth such as shown in U.S. Pat. No. 5,855,535. Other devices such as that exemplified in U.S. Pat. No. 5,035,420 are designed to provide motion to the jaw or resist motion of the jaw. U.S. Pat. No. 3,721,439 provides an exercising device which resists motion of the jaw to control the muscular effort required to close the jaw. These active devices are rather complex and expensive to manufacture. There is a need for a simple, economical, easy to operate, jaw exercising device.

OBJECTS AND SUMMARY OF THE INVENTION

It is an object of the present invention to provide a jaw exercise device which can be used in one configuration to assist and increase the opening of the jaw, and in another configuration to resist closure of the jaw.

It is a further object of the invention to provide an economical, easy-to-operate, jaw exercising device.

The foregoing and other objects of the invention are achieved by a jaw exercising device which includes and an outer frame having spaced-apart cross members and an inner frame with spaced-apart cross members, coupled to the outer frame for movement therealong. Outwardly extending blades, which are designed to fit into the mouth of a patient, are affixed to two adjacent inner and outer cross members. The blades are moved apart either by engaging the other set of adjacent cross members with the fingers of one hand and moving the inner frame along the outer frame, or by employing resilient coupling means connected between the other set of adjacent cross members.

DETAILED DESCRIPTION OF PREFERRED EMBODIMENTS

Figure 1:
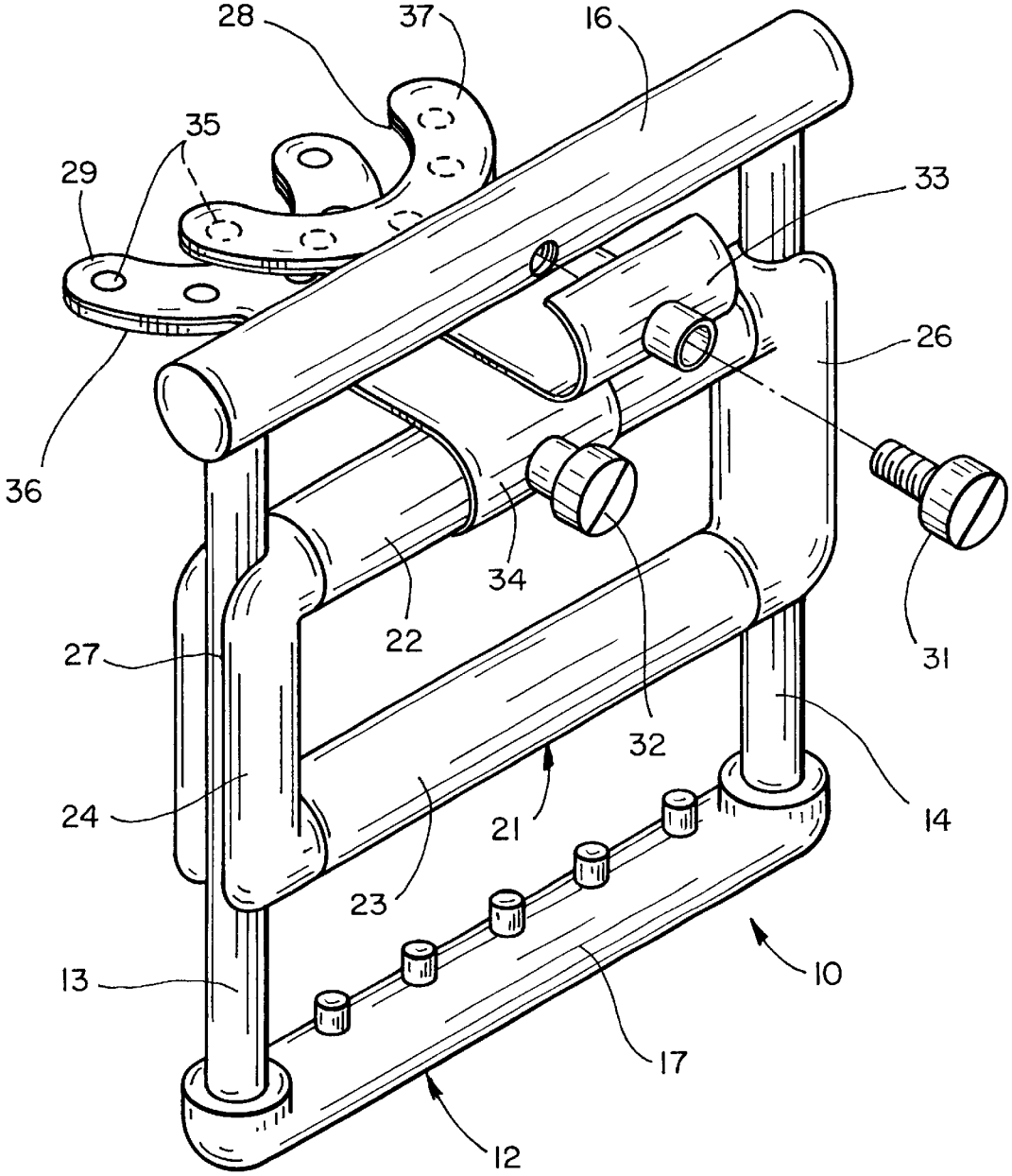
FIG. 1 is a perspective view of a jaw exercising device in accordance with the present invention.
Figure 2:
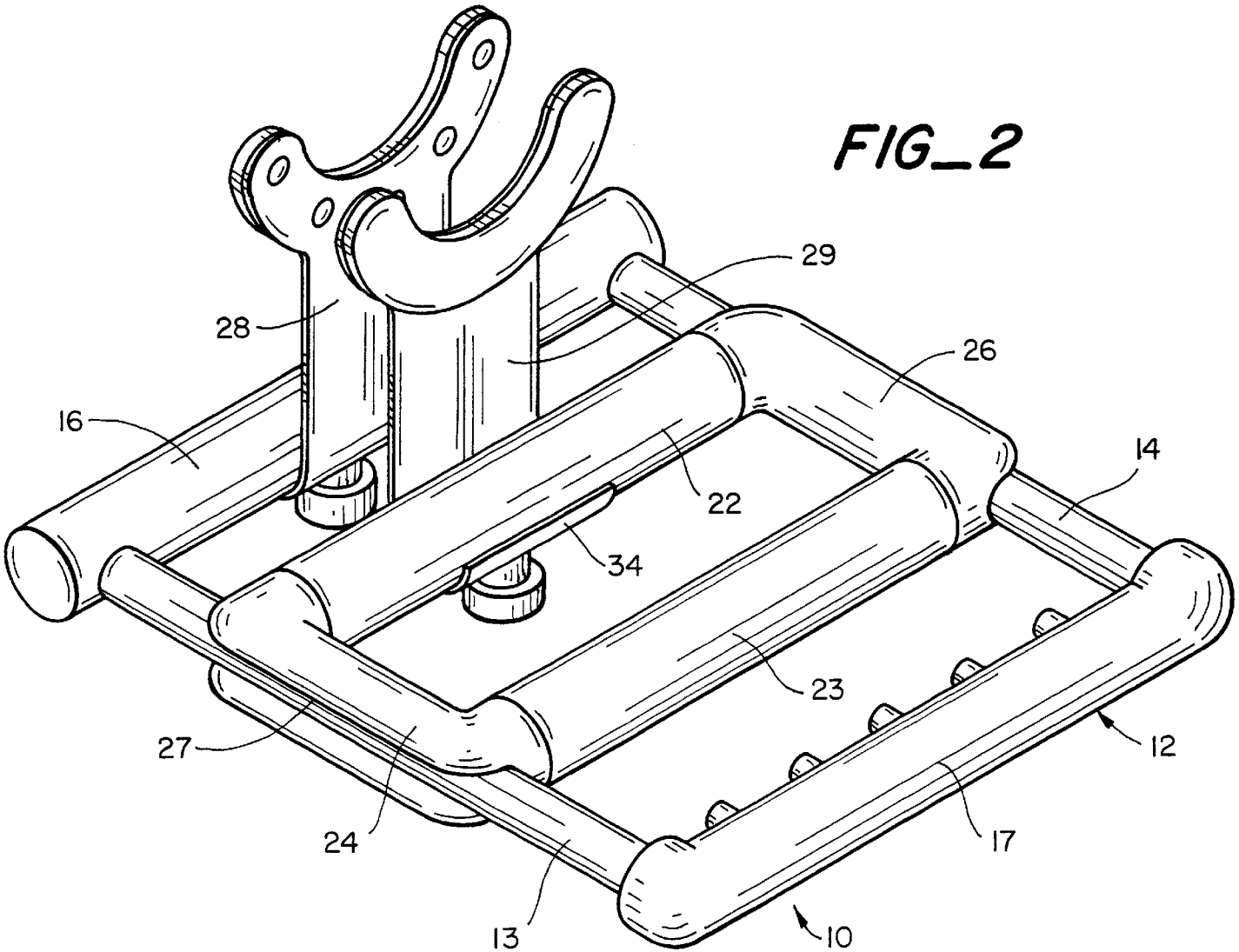
FIG. 2 is a front perspective view of the jaw exercising device of FIG. 1.

Reference will now be made in detail to the preferred embodiment of the invention which is illustrated in the accompanying figures. Turning now to the drawings wherein like components are designated by like reference numerals throughout the various figures. Attention is directed to FIGS. 1 and 2.

FIGS. 1 and 2 show a jaw exercising device 10 for exercising the facial and jaw muscles to improve the mobility of the temporal mandibular joint and to strengthen the muscles. The exercising device 10 includes an outer frame 12, which has a pair of spaced parallel rails 13 and 14, a first cross member or crossbar 16, and a second parallel cross member 17 which forms a handle. Member 17 is preferably shaped to be comfortably held by the hand of a patient during exercise as will be presently described.

An inner frame 21 is coupled to the outer frame for reciprocating movement between the cross members 16 and 17. The inner frame 21 includes first and second cross members 22 and 23. The cross member 23 is preferably shaped so that it can be easily grasped by the fingers of the patient. In one embodiment, the member 23 includes a cushioning sleeve. In another embodiment, the frame member 23 carries a rotatable cylindrical member. A pair of connecting members 24 and 26 extend between and are connected to the inner handles 22 and 23. The inner frame may be formed as a monolithic structure.

The connecting members 24 and 26 are each formed with a longitudinally extending channel 27 which is shaped to receive the rails 13 and 14 of the outer frame, and permit sliding movement of the connecting members relative to the rails 13 and 14. The spacing between the rail members 24 and 26 and the depth of the channels 27 are selected so that the inner frame is securely held within the outer frame 12 during operation of the device. Although not shown, the channel 27 may be replaced by an enclosed passageway through which the members 13 and 14 extend.

Removable and replaceable rigid metal blades, such as stainless steel blades, designed to fit into the mouth and against the upper and lower front teeth are secured to the outer rail cross member 16 and to the inner rail cross member 22. The blades 28 and 29 may be secured to the rails by a means of fastening screws 31 and 32 which extend through holes in the curved ends 33 and 34 of the blades 28 and 29. It is of course apparent that the blades 28 and 29 may be attached to the cross members 16 and 22 by other suitable means. The blades 28 and 29 are perforated 35 and receive nipples formed on one surface of molded disposable pads 36, 37. The pads 36, 37 can be of any suitable plastic material such as ethylene vinyl acetate, a plastic used in athletic dental protection, or other suitable plastic such as silicone rubber or latex-free rubber.

Figure 4:
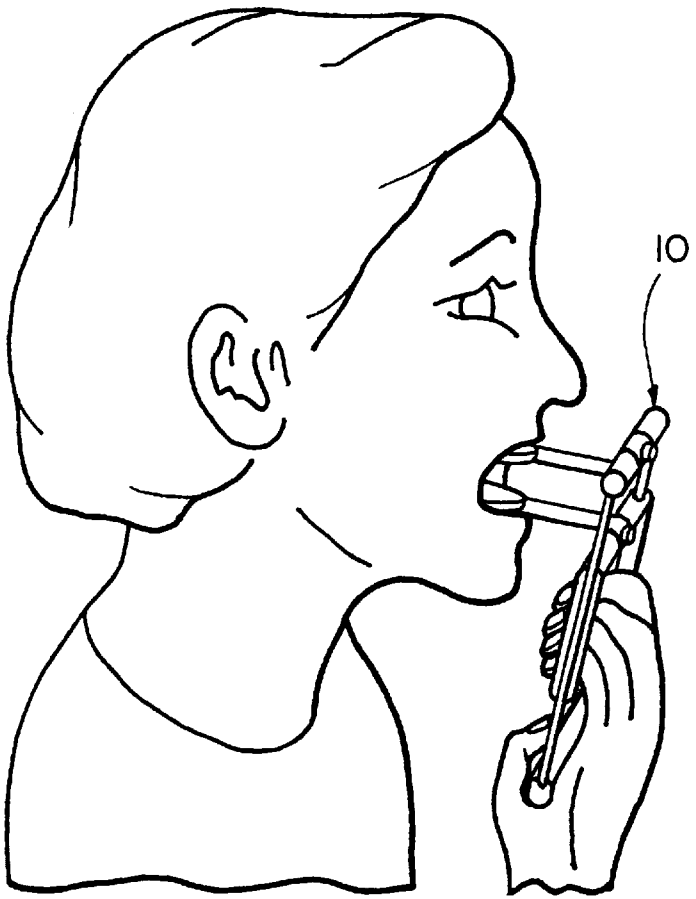
FIG. 4 is a view showing a patient using the jaw exercising device employing resilient coupling means.

The embodiments shown in FIGS. 1 and 2 is used to assist in opening the jaws. The blades are separated by moving the inner frame relative to the outer frame. More particularly, the member 23 is grasped by the fingers of the hand of a patient while the member 17 rests on the thumb or in the palm. This is illustrated in FIG. 4, where the blades are between the teeth of the patient. The patient can then close the fingers to move the inner frame downwardly to separate the blades and force the jaw open. The amount of force is, of course, controlled by the patient.

Figure 3:
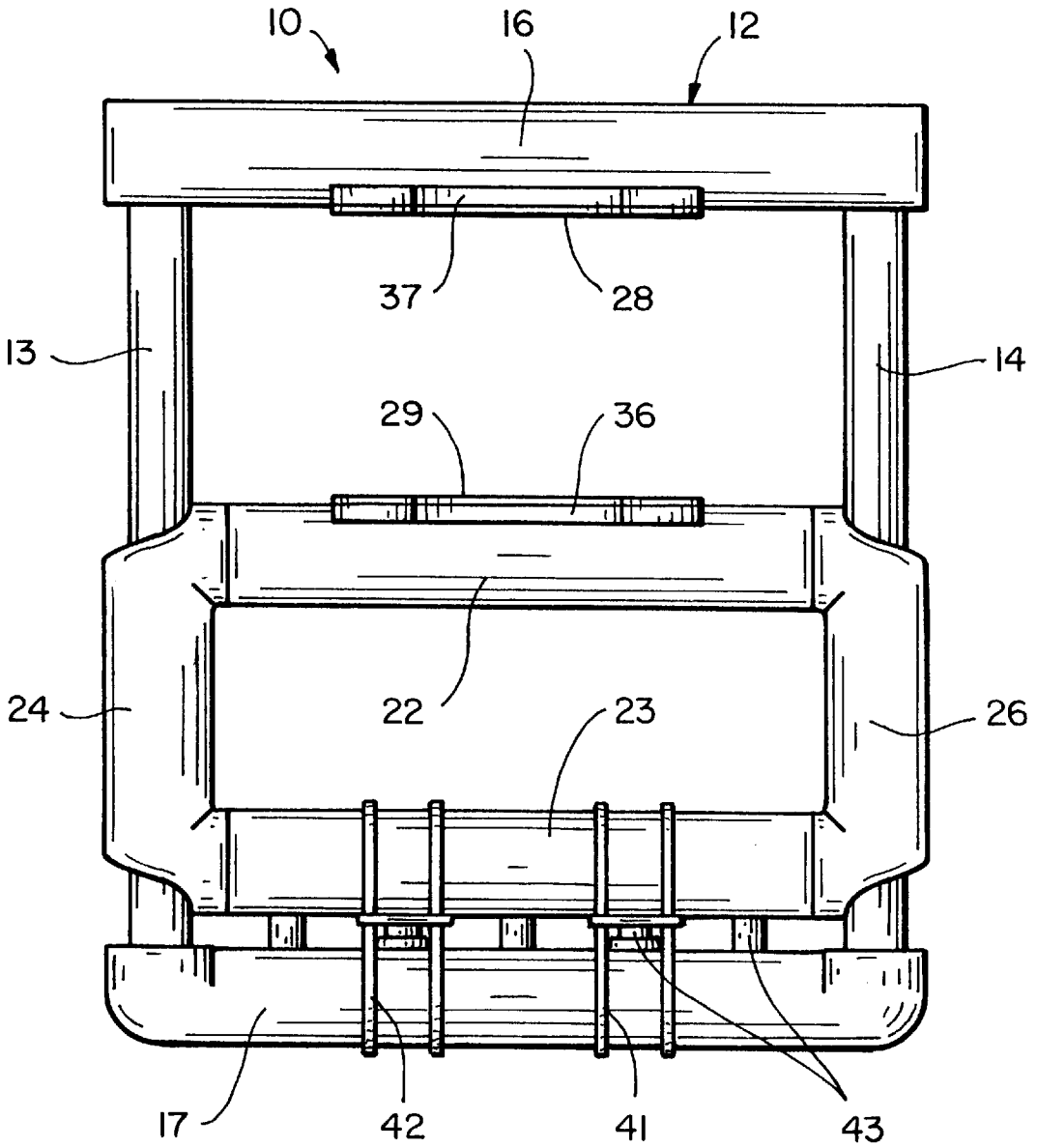
FIG. 3 is a plan view of the jaw exercising device employing resilient coupling means.
Figure 5:
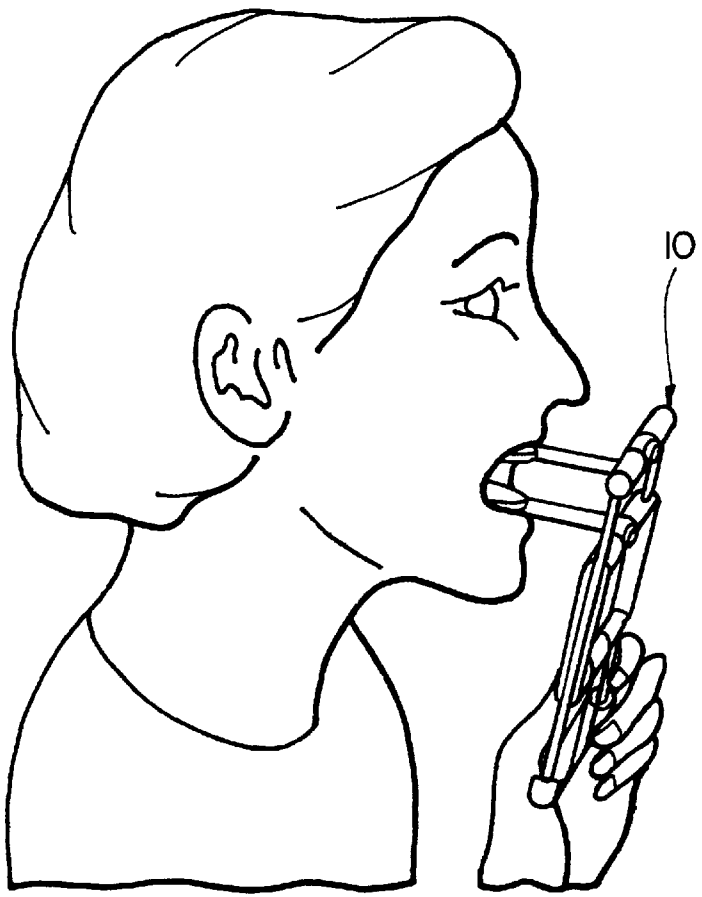
FIG. 5 is a view showing a patient using the jaw coupling device operated by the patient.

In the event continuous gentle, resistive pressure is desired, the device includes resilient coupling means which couple the members 17 and 23 to resiliently urge them to move towards one another, causing the blades to move apart. Referring to the embodiment of FIG. 3, the coupling means includes two elastic or rubber bands 41 and 42 which wrap around the crossbars 23 and 17 and are anchored to fastening means 43. Thus, as the blades 28 and 29 are moved towards one another, they must overcome the pull of the elastic bands. This will resist closure of the jaw. This is illustrated more clearly in FIG. 5 where the jaw exercising device 10 is merely held in the hand of the patient. The use of the elastic bands to provide the resistive force is an option generally used only when the person directing the use of the device suggests a stage of continuous and gentle pressure. The amount of force can of course be varied by changing the size or number of the bands which are used.

The invention now being fully described, it will be apparent to one of ordinary skill in the art that many changes and modifications can be made thereto without departing from the spirit or scope of the appended claims.

What is claimed is:

1. A jaw exercising device comprising an outer frame having a pair of parallel rods with first and second spaced outer cross members mounted transversely between the ends of said rods, an inner frame mounted in said outer frame for movement between said outer cross members along said parallel rods, said inner frame having spaced first and second inner cross members mounted on the ends of connecting members and said connecting members including means for coupling said inner fame to said outer frame for slidable movement of said inner frame within said outer frame, a first blade attached to and extending outwardly from said first outer cross member, and a second blade attached to and extending outwardly from said first inner frame cross member, said first and second blades adapted to fit within the upper and lower teeth, whereby forcing the second inner member toward the second outer member forces the jaw apart.

2. A jaw exercising device as in claim 1 in which the second cross members of said outer and inner frames are configured to be grasped by fingers.

3. A jaw exercising device as in claim 1 in which coupling means includes a resilient member to resiliently force said second inner and second outer cross members towards one another to force the jaws apart.

4. A jaw exercising device as in claims 1, 2 or 3 in which said first and second blades are configured to fit into the mouth of a patient.

5. A jaw exercising device as in claim 4 in which said blades are provided with detachable disposable molded pads.

6. A jaw exercising device as in claim 5 in which the molded pads are of a soft material.

7. A jaw exercising device as in claim 4 in which said blades are provided with molded pads made of a material selected from the group of ethylene vinyl acetate, silicon rubber and latex-free rubber.

* * * * *